United States Patent [19]

Tuttle et al.

[11] Patent Number: 4,557,664

[45] Date of Patent: Dec. 10, 1985

[54] CONTROL OF STEAM TURBINE SHAFT THRUST LOADS

[75] Inventors: Alan H. Tuttle, Andover; James K. Leonard, Wellsville; Shireesh A. Agharkar, Wellsville; John Waggott, Wellsville, all of N.Y.

[73] Assignee: Dresser Industries, Inc., Dallas, Tex.

[21] Appl. No.: 484,529

[22] Filed: Apr. 13, 1983

[51] Int. Cl.[4] ..... F01D 3/00; F01D 25/16

[52] U.S. Cl. ..... 415/105; 415/104; 415/113; 415/173 R; 415/170 R; 384/273; 384/420

[58] Field of Search ..... 415/96, 104, 113, 173 R, 415/171, 172 R, 170 R, 110, 111, 105, 201; 417/407, 408; 384/273, 420, 428; 308/DIG. 11

[56] References Cited

U.S. PATENT DOCUMENTS

| | | | |
|---|---|---|---|
| 2,465,930 | 3/1949 | Robinson | 415/172 R |
| 2,795,371 | 6/1957 | Buchi, Sr. et al. | 416/171 |
| 2,877,945 | 3/1959 | Trebilcock | 384/420 |
| 3,043,560 | 7/1962 | Varadi | 416/74 |
| 3,129,922 | 4/1964 | Rosenthal | 415/170 R |
| 3,160,107 | 12/1964 | Ross | 415/201 |
| 3,431,032 | 3/1969 | Haentjens | 384/273 |
| 3,527,053 | 9/1970 | Horn | 415/116 |
| 3,565,543 | 2/1971 | Mrazek | 415/106 |
| 3,702,719 | 11/1972 | Hoffman | 384/306 |
| 3,723,022 | 3/1973 | Olson | 417/407 |
| 3,734,580 | 5/1973 | Piscitelli | 384/273 |
| 3,806,135 | 4/1974 | Wiese | 415/113 |
| 3,817,586 | 6/1974 | Elwell | 308/160 |
| 3,941,437 | 3/1976 | MacInnes et al. | 308/121 |
| 3,989,410 | 11/1976 | Ferrari | 415/115 |
| 4,005,572 | 2/1977 | Giffhorn | 415/212 R |
| 4,137,006 | 1/1979 | Becker | 415/201 |
| 4,152,092 | 5/1979 | Swearingen | 415/172 R |
| 4,183,713 | 1/1980 | Erickson et al. | 415/104 |
| 4,241,958 | 12/1980 | Moller et al. | 308/160 |
| 4,304,522 | 12/1981 | Newland | 415/135 |

*Primary Examiner*—Abraham Hershkovitz
*Assistant Examiner*—H. Edward Li

[57] ABSTRACT

An overhung steam turbine is described which features a seal assembly and a bearing assembly to minimize axial shaft movement. The seal assembly forms a pressure barrier between a relatively low vacuum exhaust region and an exhaust cavity disposed at one end of the rotor shaft to minimize the pressure differential across the ends of the shaft and the resultant thrust force of the rotor shaft against the turbine casing. A bearing assembly is provided which includes a pair of journal bearings and a pair of oppositely disposed thrust bearings. In one embodiment one thrust bearing is connected by an adapter ring which is mounted to a horizontally split bearing casing. In another embodiment, the thrust bearing is carried by one of the journal bearings. The journal bearings are preferrably connected by horizontally split ring bearings to facilitate insertion and removal of the bearings without removing the overhung shaft.

4 Claims, 5 Drawing Figures

CONTROL OF STEAM TURBINE SHAFT THRUST LOADS

TECHNICAL FIELD

This invention relates to overhung steam turbines and, more particularly, to an arrangement and apparatus for reducing axial shaft movement or load in such turbines.

BACKGROUND OF THE INVENTION

Turbo machines are subjected to thrust loads, both radial and axial. It is necessary for the bearings of the machine to support such loads but excessive loads cause power loss and wear. Accordingly, means are needed to control shaft loads. This invention pertains to controlling the axial thrust load of an overhung steam turbine.

By nature of its design an overhung turbo machine has an axial thrust load imposed upon it generally equal to the product of: (1) the area of the missing shaft protuberance (i.e., overhung end); and (2) the differential pressure relative ambient applied to this area. This invention counteracts this problem by employing a sealed balance piston on the overhung shaft end which can be vented to an ambient to balance the thrust or vented to another control pressure to counteract any other net unbalanced force across the turbine.

Conventional methods of solving this problem have included the use of thrust bearings. The use of thrust bearings in such applications is shown in U.S. Pat. Nos. 4,304,522 to Newland; 4,241,958 to Moller et al.; 4,005,572 to Giffhorn; 3,941,437 to MacInnes et al.; 3,817,568 to Elwell; 3,702,719 to Hoffman; and 2,877,945 to Trebilcock. Thrust bearings work best, however, when the load is relatively constant or slowly varying over time.

In the case of gas turbines, positive pressure has been used to help equalize the pressure differential across the rotor shaft. An approach using exhaust air or gas is illustrated in U.S. Pat. Nos. 3,565,543 to Mrazek and 4,152,092 to Swearingen. Still another approach has employed labyrinth seals to prevent leakage from a high pressure to a low pressure region to stabilize the loading on the thrust bearings. U.S. Pat. Nos. 3,129,922 to Rosenthal and 3,043,560 to Varadi are two basic examples. Labyrinth seals have also been used on the downstream side of a rotor to inject cooling air into a chamber or region downstream of the rotor vanes (i.e., U.S. Pat. No. 3,527,053 to Horn and 3,989,410 to Ferrari). However, in overhung steam turbines, such as that shown in U.S. Pat. No. 2,795,371 to Buchi, Sr., et al., these techniques have not been perfected to the satisfaction of the industry.

Even with such pressure equalizing features to minimize axial thrust variations, thrust bearings still wear out and must be replaced. In some overhung turbines, the thrust and journal bearings are enclosed in a bearing housing located immediately upstream of both the rotor and an associated shaft seal assembly. This arrangement improves rotor stability. In some compact designs both the thrust bearings and the journal bearings are often mounted in a common housing or bearing case which must be designed to allow removal of the rotor shaft through the turbine casing. This is by far a difficult and time consuming task. Thus, any solution to the problem of varying thrust loading must accomodate the practical necessity of both shaft removal and bearing replacement under difficult conditions of access.

SUMMARY OF THE INVENTION

A principal object of the present invention is to provide an apparatus for minimizing the change in thrust forces across the shaft of an overhung steam turbine.

A more particular objective is to provide a seal assembly for reducing the downstream thrust on the rotor shaft of an overhung turbine wherein one part of the shaft is disposed outside a seal cavity and in flow communication with the downstream side or exhaust (condenser) side of the turbine rotor and another part of the shaft is disposed inside the seal cavity and in flow communication with a region of relatively constant (near atmospheric) pressure produced by a pressure mechanism such as a gland exhaust system. In one embodiment the seal assembly comprises a first seal member which is fixedly attached to the turbine casing and a second seal member which is attached to the overhung end of the turbine rotor shaft. The first seal member is fixed within the aforesaid exhaust cavity and is in flow communication with a source of relatively fixed pressure (i.e., the gland exhaust system). The first seal member has an open end disposed towards the overhung end of the rotor shaft. The second seal member is attached to the rotor shaft and is in sealing engagement with the first seal member. The seal assembly thereby forms a zone, immediately downstream of the overhung end of the shaft, which is at a generally atmospheric pressure. In this manner, the force imposed on the free end of the shaft by the surrounding atmosphere is balanced.

In a preferred embodiment, the first and second seal members comprise a labyrinth seal, the overhung turbine has an exhaust diffuser at the downstream end of the rotor, and the first seal member includes a seal ring fixedly mounted on to the exhaust diffuser.

A further object of the present invention is to provide a seal assembly which may be readily substituted for, or used in conjunction with, the windage seal ring otherwise mounted to the end of the rotor shaft. In those turbines the rotor shaft includes means for removably mounting the windage seal ring thereto. Thus, the second seal member is provided with means, complementary to the aforesaid mounting means, for mounting the second seal member in lieu of windage seal ring to the rotor shaft.

Yet another objective of the present invention is to provide a bearing assembly for the shaft of an overhung turbine in which a pair of journal bearings support the shaft, a pair of opposed thrust bearings restrain the shaft against axial movement, and means are provided for mounting one of the thrust bearings to one of the journal bearings such that the shaft may be readily removed through the turbine casing. Preferably, the bearings are horizontally split, as is the bearing housing which encloses the bearings, so that the thrust bearings and journal bearings may be readily changed without removing the shaft.

Still another object of the present invention is the provision of a bearing assembly in an overhung turbine in which a pair of journal bearings and a pair of thrust bearings support a shaft, and means are provided for mounting one of the thrust bearings to a removable ring carried by the bearing housing. In this embodiment a split adapter ring is carried by the bearing housing, instead of by one of the journal bearings, as in the earlier embodiment. Preferably, a housing for the bearing assembly is horizontally split, the adapter ring is horizontally split and both the journal bearings and thrust bearings are horizontally split to facilitate rapid assembly and disassembly of the bearings without removal of the shaft.

BRIEF DESCRIPTION OF THE DRAWINGS

The foregoing objects and advantageous features will be described in greater detail and further objects, advantages and features will be made apparent in the following detailed description of the preferred embodiment which is given with reference to the several views of the drawing, in which.

DETAILED DESCRIPTION

Figure 1:
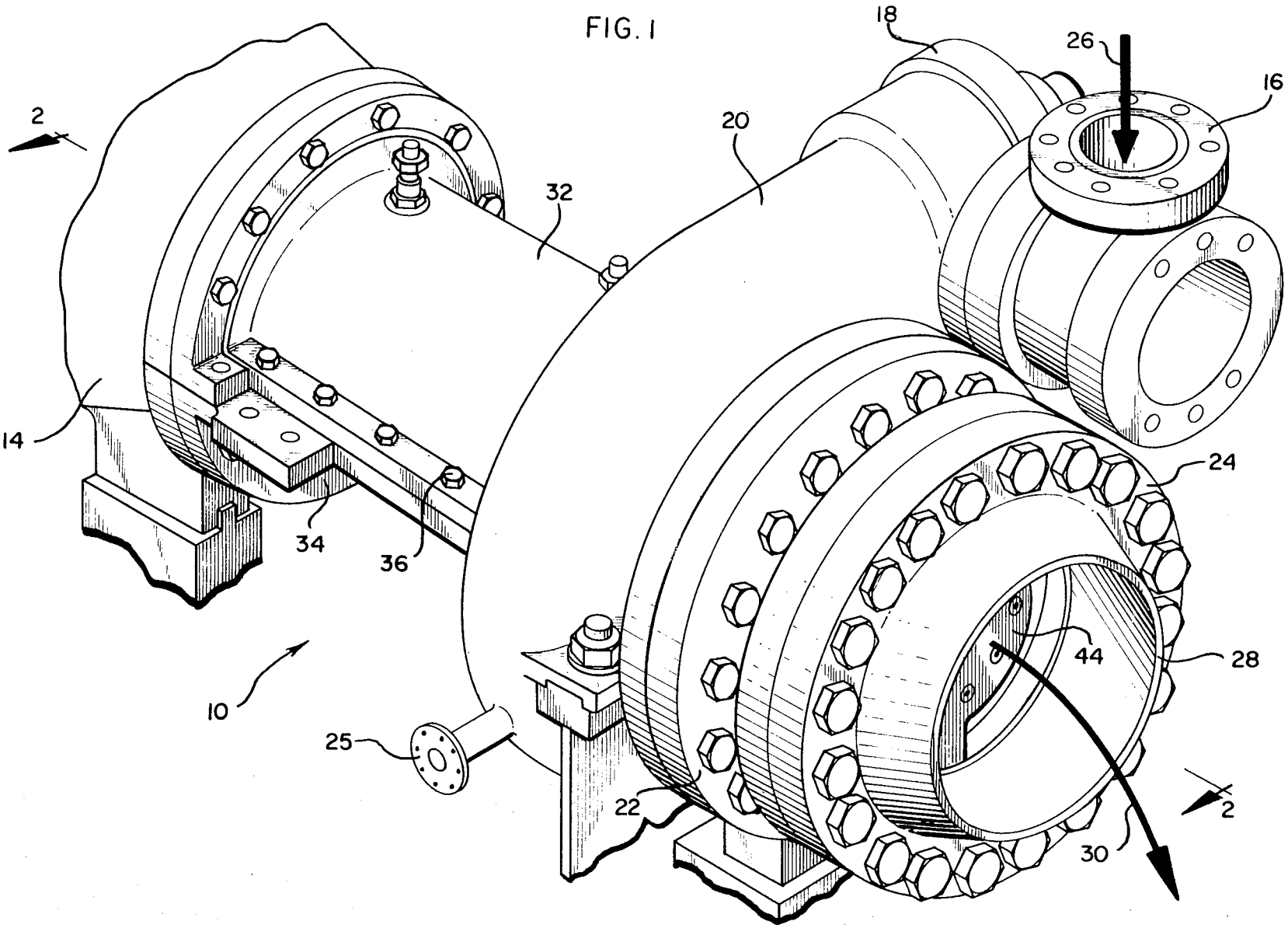
FIG. 1 is a perspective view of an overhung turbine in which the preferred embodiment of the present invention is employed.

While this invention is susceptible to embodiment in many different forms, there is shown in the drawings and will herein be described in detail, several specific embodiments, with the understanding that the present disclosure is to be considered an exemplification of the principals of the invention and that it is not intended to limit the invention to the specific embodiments illustrated.

Before describing the details of the invention, the overall apparatus of an overhung steam turbine will be described in detail so that the unique aspects of the invention will be more readily appreciated.

Referring now to FIG. 1, an overhung steam turbine employing the axial shaft movement minimizing apparatus of the present invention is illustrated. The turbine includes a turbine case 10, a horizontally split bearing case 12, and a transmission case 14. The turbine case 10 includes a steam inlet 16 which is adapted to be connected to a source of pressurized steam, a governor valve casing 18, an annular steam chest 20, a rotor casing 22, and a combined diffuser and exhaust outlet casing 24. The pressurized steam enters the inlet 16 (in the direction indicated by arrow 26) passes through the governor valve and into the steam chest 20. From the steam chest 20, the high pressure steam passes through the rotor vanes (i.e., buckets) within the rotor case 22 to impart rotational movement thereto. The exhaust steam then exits through a diffuser 44 (see FIG. 2) within the exhaust outlet casing 24 and an exhaust port or cavity 28 to a condenser (not shown for purposes of clarity) in the direction indicated by arrow 30. The direction of arrow 30 defines an upstream reference for the turbine; the downstream zone being towards the condenser. Casing drains and gland exhaust ports 25 are also provided. A rotor shaft 31 (See FIG. 2) extends through the bearing case 12 and into the transmission case 14 within which a suitable reduction gear and other load bearing elements are contained.

In keeping with one aspect of the present invention, the bearing case 12 comprises a horizontally split housing formed from two flanged half casings 32 and 34. These are secured together along their contiguous sides by bolts 36. The bearing case 12 contains split journal bearings, such that the bearings may be changed without removal of the rotor shaft 31 (see FIG. 2). Access is gained to the bearings by removing the upper casing section 32 from the lower casing section 34, separating the two halves of the bearings to be changed, substituting new bearing pads for the worn bearing pads, reassembling the bearings and then reassembling the two casing sections 32 and 34.

Figure 2:
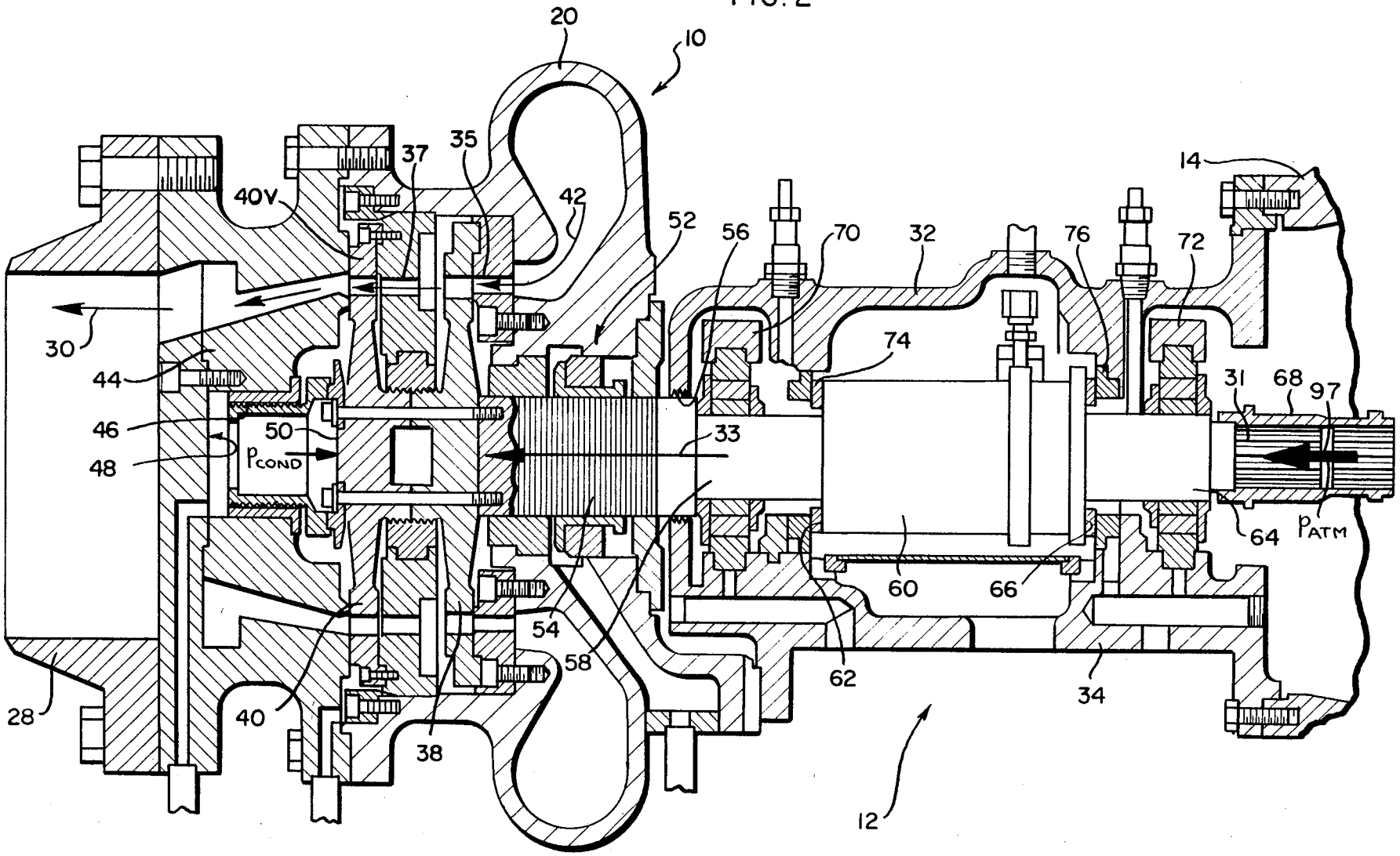
FIG. 2 is a sectional view of the turbine shown in FIG. 1 taken along section line 2—2 of FIG. 1.

Referring now to FIG. 2, an overhung rotor assembly 33 is illustrated. The assembly is located within the turbine case 10 adjacent the annular steam chest 20. Pressurized steam within steam chest 20 passes through annular ports 35 and 37 (fixed buckets) and past a plurality of rotor vanes 38V and 40V on the two rotors 38 and 40 (rotating buckets) in the direction indicated by arrows 42. The exhaust steam passes through an annular diffuser 44 and then exits out of the exhaust port 28.

Those skilled in the art know that the flow of pressurized steam through an overhung turbine results in a differential pressure force or thrust being imposed across the rotor shaft (i.e., the force of the atmosphere on the free or output end of the shaft). Here a seal assembly 46 is provided to reduce the differential pressure across the ends of the rotor shaft (i.e., $P_{atm}$ vs. $P_{cond}$). Effectively, the seal assembly 46 is used to form a zone 48, immediately downstream of the end 50 of the rotor shaft 31 which is maintained relatively close to atmospheric pressure. Thus, by increasing the pressure at the central portion or end 50 of the shaft 31, the upstream directed axial thrust against the rotor shaft is increased relative to that of a shaft fully exposed to the exhausting steam in the cavity 48.

Located upstream of rotors 38 and 40, but still contained within rotor case 22, is a seal assembly 52 which includes a plurality of split-ring seals that sealingly engage a section 54 of the rotor shaft 31 located immediately forward or upstream of the turbine case 10. The rotor shaft 31 extends into the bearing casing 12 through an oil dam 56 associated therewith. A reduced diameter section 58 of the rotor shaft 31 joins with an enlarged section 60 of the rotor shaft to define a ring-like shoulder 62. Still further upstream, the enlarged diameter section 60 of the rotor shaft 31 joins with another reduced diameter section 64 to define another ring-like shoulder 66. The rotor shaft 31 then engages a coupler 68 which mates with a shaft (not shown) in the transmission case 14 (See FIG. 1).

Figures 4, 5:
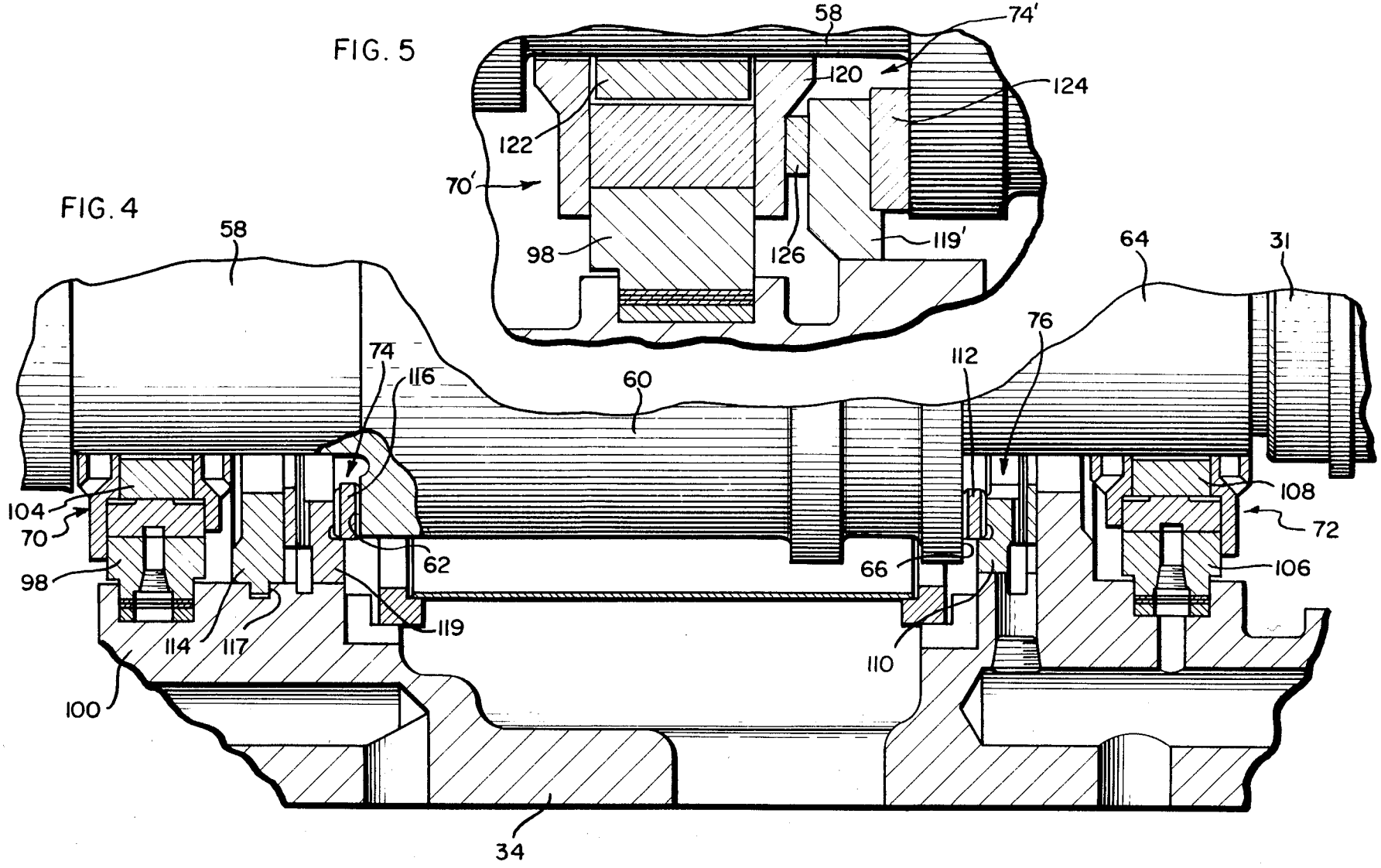
FIG. 4 is a portion of FIG. 2 enlarged to more clearly illustrate the bearing assembly of the present invention.
FIG. 5 is an enlarged portion of FIG. 4 which illustrates another embodiment of the bearing assembly.

Referring to FIGS. 4 and 5, pursuant to another aspect of the present invention, a pair of journal bearing assemblies 70 and 72 are mounted within the bearing casing 12 to provide support of the rotor shaft 31 at either side of the enlarged diameter section 60 of the shaft. These journal bearing assemblies 70 and 72 are horizontally split to facilitate removal and replacement of bearing elements without requiring removal of the rotor shaft 31 from the bearing casing 12. A pair of thrust bearing assemblies 74 and 76 assist in minimizing resultant axial movement of the rotor shaft 31. Clearly, the pressure drop across the turbine rotors 38 and 40 and the unequal pressure across the ends of the shaft results in a net force on the shaft 31 in the downstream direction. The thrust bearing assemblies 74 and 76 are respectively located adjacent the shoulders 62 and 66 at either end of enlarged shaft section 60. As will be explained in greater detail, in one embodiment of the present invention, one thrust bearing assembly 74 may be carried by a horizontally split adapter ring 76 which is mounted to the lower bearing casing 34 (See FIGS. 2 and 4). In another embodiment, the thrust bearing assembly 74 is mounted directly to the adjacent journal bearing assembly 70 (See FIG. 5).

Figure 3:
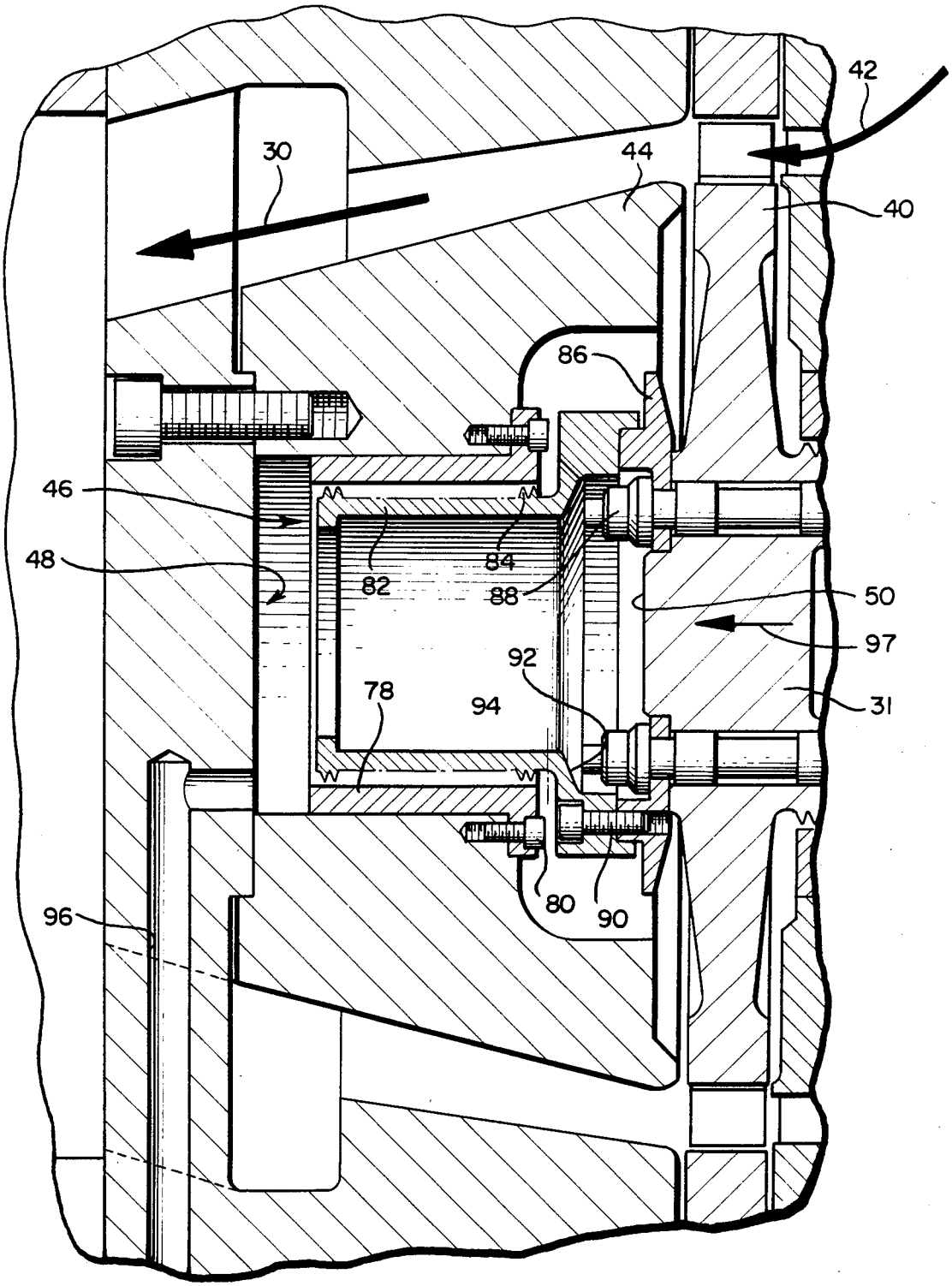
FIG. 3 is a portion of FIG. 2 which is enlarged to more clearly illustrate the seal assembly of the present invention.

Now that the overall arrangement of the major components of the invention have been described, the seal assembly 46 will be described in greater detail. Referring now to FIG. 3, the seal assembly 46 is a two part labyrinth seal comprising: a cylindrical first seal member 78 which is removably attached to the exhaust diffuser 44 by means of a screws or bolts 80; and a second seal member 82 which contains teeth elements 84 and which is removably attached to the overhung end of the rotor shaft 31 by means of a seal mounting ring 86. The seal mounting ring 86 is removably attached to the rotor shaft 31 by means of the fasteners or bolts 88 used to hold the rotors 38 and 40 onto the rotor shaft. The second seal member 82, in turn, is removably attached to the seal mounting ring 86 by means of threaded fasteners 90 (only one being shown for purposes of clarity).

In keeping with another aspect of the present invention, the seal assembly 46 is adapted to be retrofit to a steam turbine having a pre-existing windage seal ring attached to the overhung end of the rotor shaft 31 by the rotor fasteners or bolts 88. In other words, that portion 92 of second seal member 82 is defined, in part, by broken line 94 is preferably identical to the preexisting windage seal ring. In keeping with this aspect of the invention, the windage seal ring, normally attached to the seal mounting ring 86 by fasteners 90, is disconnected from rotor 40 and the second seal member 82 is mounted to the rotor in its place.

The diffuser 44 defines a pocket shaped region 48 located directly behind or downstream a central portion 50 of the rotor shaft 31. The bolt circle on the seal mounting ring 86 for fasteners 90 is located at a peripheral portion of the rotor shaft 31 (i.e., radially spaced from the central portion 50 of the rotor shaft). Accordingly, the second seal member 82 has a generally "L-shaped" cross section and somewhat resembles a top-hat with a main or raised portion extending inwardly from a peripheral or brim portion into the second seal member 82 and into the pocket 48 at the downstream end of the diffuser 44.

The pocket 48 defined by the diffuser 44 and the seal assembly 46 is in flow communication with a gland exhaust duct 96. In the absence of the seal assembly 46, the central portion 50 of the rotor 40 would essentially be at the pressure of the condenser inlet. This pressure may be very near a vacuum (lightly loaded turbine) or at a slight back pressure (heavily loaded turbine). In any case, the pressure is less than that of the surrounding atmosphere. The seal assembly 46 as such insures that the pressure at the overhung end of the rotor shaft 31 is relatively high compared to a vacuum and essentially close to that of surrounding atmosphere. Thus, the differential pressure across the axis of the rotor shaft 31 is reduced and the downstream directed thrust (see arrow 97) created by such a pressure difference is thereby reduced when the seal assembly 46 is in place. Moreover, this reduces the thrust forces on the associated thrust bearing assembly 74 and the wear on the thrust bearing pads of that assembly.

Referring now to FIG. 4, the embodiment of the bearing assembly 74 shown in FIG. 2 is illustrated in greater detail. One thrust bearing assembly 74 includes a base member 98 carried by the lower bearing casing 34 by means of suitable fasteners and shims. Secured to the base member 98 are a plurality of journal bearing pads 104 in load bearing relationship with one section 58 of the rotor shaft 31. Likewise, the other journal bearing 72 has a base 106 carried by the lower bearing casing 34 which, in turn, carries a plurality of replaceable journal bearing pads 108. These bearing pads 108 are adjustably mounted in load bearing relationship with a section 64 of the rotor shaft 31.

The thrust bearing assembly 76 located at the upstream shoulder 66 of the enlarged shaft section 60 includes a horizontally split base ring 110 mounted to the lower bearing casing 34. A plurality of tilting lands or thrust bearing pads 112, in turn, are mounted to the base ring 110. Pads 112 are designed to tilt about a radial axis of the rotor shaft 31 and are held in load bearing relationship with the shoulder 66 of the shaft.

The other thrust bearing assembly 74 resists axial movement of the rotor shaft in a downstream direction. Unlike assembly 76, it includes a horizontally split base 119 which is mounted to a horizontally split adapter ring 114. The adapter ring 114 is radially spaced from the rotor shaft section 58 supported by the adjacent journal bearing 70. It is mounted in a notch or groove 117 defined by the lower half of the split bearing casing 12. Like the other thrust bearing assembly 76, a plurality of tilting land thrust bearing pads 116 are mounted to the base 119 in load bearing relationship with a shoulder 62 on the rotor shaft 31.

Referring now to FIG. 5, an alternate embodiment of a downstream thrust bearing assembly 74' is illustrated which may by used in place of the assembly 74 shown in FIG. 4. Instead of its base 119' being mounted to an adapter ring 114, the base 119' is mounted directly to the base 98 of journal bearing assembly 70'. Like bearing assembly 70, this journal assembly 70' has a plurality journal bearing pads 122 mounted to its base 98 and in load bearing relationship with a section 58 of the rotor shaft 31. This thrust bearing assembly 74' also has bearing pads 124 carried by the base 119'. The base 119 is interconnected to the base 98 of the journal bearing 70' by means of a coupler ring 126.

In keeping with an important aspect of the present invention, all of the bearing assemblies 70, 72, 74, 76, as well as the bearing casing 12, are horizontally split to enable removal of the bearing assemblies for replacement of the respective bearing pads without the necessity of removing the rotor shaft 31.

A prototype of the invention was successfully installed on an overhung steam turbine having a twelve inch pitch diameter and a nominal design speed of 20,000 RPM. This particular turbine produced up to three thousand horse power at an output speed of 500 to 18,000 RPM through an epicyclic type gear transmission or at a speed 20,000 RPM through a direct drive. Inlet steam conditions were in the range of 700 PSIG and 750° F. Back pressure varied from 300 RSIG to condensing pressure. The forward thrust bearing in one test was found to be able to sustain a thrust load of 1000 lbs without overheating. Tests also showed that rotor components could be changed in about two hours. This is by far a significant improvement.

From the foregoing, it will be observed that numerous variations and modifications may be effective without departing from the true spirit and scope of the novel concept of the invention. For example, although one embodiment of the invention has been described wherein an adapter ring is used to mount one of the thrust bearings, the adapter ring concept may be used to mount both thrust bearings. One advantage of this latter arrangement is that the number of unique parts is kept to a minimum and replacement part stocking is vacilitated. Another variation would be to subject the sealed zone of the sealed assembly to a controlled pressure to balance any other thrust loads of the turbine or its installation. Thus, it should be understood that no limitation with respect to specific apparatus illustrated herein is intended or should be inferred. It is, of course, intended to cover by the appended claims all such modifications as falls within the scope of the claims.

We claim:

1. In a single axial flow overhung steam turbine of the type having a high pressure input, a low pressure exhaust cavity, a rotor casing defining a steam passage from said input to said exhaust cavity, a rotor shaft supported for rotation within said casing and having a downstream end disposed in said exhaust cavity, a rotor mounted on said rotor shaft in flow communication with said steam passage from said input to said exhaust cavity for converting steam pressure into rotational force, an improved seal and bearing arrangement comprising:

(a) an exhaust diffuser mounted to said rotor casing within said exhaust cavity defining a pocket having an open end adjacent said downstream end of said rotor shaft and a closed end downstream from said open end;

(b) a first circular seal member sealingly mounted to the open end of said pocket;

(c) a second circular seal member sealingly mounted to the downstream end of said rotor shaft for sealing rotational engagement with said first circular seal member so that said pocket is sealed from said exhaust cavity;

(d) a duct means for providing the interior of said sealed pocket with atmospheric pressure, whereby unbalanced axial force on said rotor shaft is reduced;

(e) a split housing assembly detachably mounted in a fixed relationship to said rotor casing;

(f) a split journal bearing detachably mounted to said split housing for providing radial load bearing support to said rotor shaft, whereby said journal bearing may be replaced without removing said rotor shaft; and (g) a thrust bearing detachably mounted to said split housing for providing axial load bearing support to said rotor shaft, whereby said thrust bearing may be replaced without removing said rotor shaft.

2. An improved seal and bearing arrangement as in claim 1 wherein said first and said second circular seal members comprise first and second labyrinth seal members mounted in cooperative labyrinth sealing relationship.

3. An improved seal and bearing arrangement as in claim 2 further comprising:

(a) means for removably mounting said first labyrinth seal member to said pocket defined by said exhaust diffuser; and (b) means at the periphery of the downstream end of said rotor shaft for removably mounting said second labyrinth seal member.

4. An improved seal and bearing arrangement as in claim 1 wherein said thrust bearing comprises:

(a) a first thrust bearing for providing axial support to said rotor shaft in the upstream direction detachably mounted on said split apart journal bearing;

(b) a second thrust bearing for providing axial support to said rotor shaft in the downstream direction;

(c) a split adapter ring removably mounted to said split housing; and (d) means for detachably mounting said second thrust bearing to said split adapter ring.

* * * * *